United States Patent [19]

Nasu

[11] Patent Number: 4,995,287

[45] Date of Patent: Feb. 26, 1991

[54] APPARATUS FOR CUTTING LAMINATED SHEET MATERIAL

[75] Inventor: Nobuo Nasu, Fukuyama, Japan

[73] Assignee: Kabushiki Kaisha Kawakami Seisakusho, Hiroshima, Japan

[21] Appl. No.: 452,785

[22] Filed: Dec. 19, 1989

Related U.S. Application Data

[62] Division of Ser. No. 177,968, Apr. 5, 1988.

[30] Foreign Application Priority Data

Apr. 23, 1987 [JP] Japan ..... 62-100955

[51] Int. Cl.[5] ..... B26D 7/01; D06H 7/00

[52] U.S. Cl. ..... 83/169; 83/427; 83/428; 83/938; 83/939

[58] Field of Search ..... 83/938, 939, 936, 451, 83/152, 402, 169, 353, 424, 427, 428, 433, 647, 940, 937

[56] References Cited

U.S. PATENT DOCUMENTS

| | | | |
|---|---|---|---|
| 3,548,502 | 12/1970 | Baldwin | 83/938 X |
| 3,573,859 | 4/1971 | Sederberg | 83/938 X |
| 3,589,222 | 6/1971 | Sederberg | 83/938 X |
| 3,797,341 | 3/1974 | Bystron | 83/938 X |
| 4,542,672 | 9/1985 | Pearl | 83/938 X |
| 4,725,393 | 2/1988 | Nasu | 83/451 X |
| 4,759,677 | 7/1988 | Lukens, Jr. | 83/938 X |

*Primary Examiner*—Paul A. Bell
*Assistant Examiner*—Kenneth E. Peterson
*Attorney, Agent, or Firm*—Ladas & Parry

[57] ABSTRACT

An apparatus for cutting a laminated sheet material includes a pedestal for supporting on a support surface thereof a laminate of a sheet material at least the upper and lower surfaces of which are covered with an air-impermeable sheet. Arranged on the support surface is a suction pipe a side face of which is provided with a suction port for attracting a side face of the laminate. Connected to the suction pipe is a suction pipe drive unit for reciprocating the suction pipe in one direction. Coupled to a cutter head arranged above the laminate is a cutter head drive unit for reciprocating the cutter head in a direction orthogonal to the direction in which the suction pipe is reciprocated. A guide groove opposing the path along which the cutter head is reciprocated is provided in the support surface of the pedestal, and a number of closure plates driven in synchronization with the cutter head are fitted in the guide groove, the closure plates being interconnected. Connected between closure plates via a mounting member is a cutter receiving sleeve into which the tip of a cutter, which is attached to the cutter head, is movably inserted. The upper surfaces of the closure plates, cutter receiving sleeve and mounting member are arranged to be flush with the support surface.

1 Claim, 9 Drawing Sheets

APPARATUS FOR CUTTING LAMINATED SHEET MATERIAL

This is a divisional of co-pending application Ser. No. 07/177,968 filed Apr. 5, 1988.

BACKGROUND OF THE INVENTION

This invention relates to an apparatus for cutting a sheet material such as cloth in the form of a laminate consisting of a number of sheets.

An example of a conventional cutting apparatus of this type is as disclosed in the specification of Japanese Patent Publication (KOKOKU) No. 51-19193. The apparatus includes a pedestal having a supporting surface provided with a suction port. A laminate of a sheet material covered with an air-impermeable sheet with the exception of the lower surface thereof is held fast to the supporting surface by suction, and a cutter head having a cutter is reciprocated in mutually perpendicular X and Y directions to cut the laminate into a desired shape by means of the cutter. In order to prevent the supporting surface from being damaged by the tip of the cutter, a bottom member reciprocated in the X direction is provided on the supporting surface over the entire length thereof in the Y direction, and the bottom member is provided with a receiving cylinder movable in the Y direction for loosely receiving the tip of the cutter.

A problem encountered in this conventional laminated sheet cutting apparatus is that since the portion of the laminate cut by the cutter is caused to curve or bend by the bottom member on the supporting surface, the sheets of the laminate fail to be cut precisely into the desired shape. Another problem is that since it is required that the bottom member be moved against the suction produced by the suction port, it is difficult to move the cutter head and bottom member smoothly even if a large driving force is used.

SUMMARY OF THE INVENTION

Accordingly, an object of the present invention is to provide a laminated sheet material cutting apparatus in which each sheet of a laminate can be cut accurately and the cutter head can be moved smoothly with a comparatively small driving force.

According to the present invention, the foregoing object is attained by providing an apparatus for cutting a laminate of sheet material at least upper and lower surfaces of which are covered with an air-impermeable sheet, comprising: a pedestal having a supporting surface on which the laminate is supported; a suction pipe arranged on the supporting surface and having a side face provided with a suction port for attracting a side face of the laminate; suction pipe driving means coupled to the suction pipe for reciprocating the suction pipe in one direction; a cutter head supported above the laminate and having a cutter attached thereto; cutter head driving means coupled to the cutter head for reciprocating the cutter head in a direction orthogonal to the direction in which the suction pipe is reciprocated; the supporting surface having a guide groove opposing a path along which the cutter head is reciprocated; a number of interconnected closure plates fitted into the guide groove and driven in synchronization with the cutter head; a cutter receiving sleeve for receiving a tip of the cutter movably inserted therein; and a mounting member for connecting the cutter receiving sleeve between closure plates; upper surfaces of the closure plates, the cutter receiving sleeve and the mounting member being made flush with the supporting surface.

Thus, the closure plates driven in synchronization with the cutter head are reciprocatively fitted into the guide groove provided in the supporting surface of the pedestal, the closure plates are interconnected, the cutter receiving sleeve is connected between closure plates via the mounting member, and the upper surfaces of the closure plates, cutter receiving sleeve and mounting member are arranged to be flush with the support surface. As a result, the cutter is capable of cutting down to the lowermost layer of the laminate, which remains perfectly flat without bends or curves, thereby making it possible to accurately cut each sheet of the laminate into the prescribed shape. Furthermore, in accordance with the invention, the closure plates moved in synchronization with the cutter head, the mounting member and the cutter receiving sleeve do not project from the support surface, and the laminate is retained by suction produced from the side of the suction pipe and is not held fast to the support surface by suction. This enables the cutter head and the laminate to be moved smoothly with a comparatively small driving force.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENTS

Embodiments of the present invention will now be described in detail with reference to the accompanying drawings.

Figure 1:
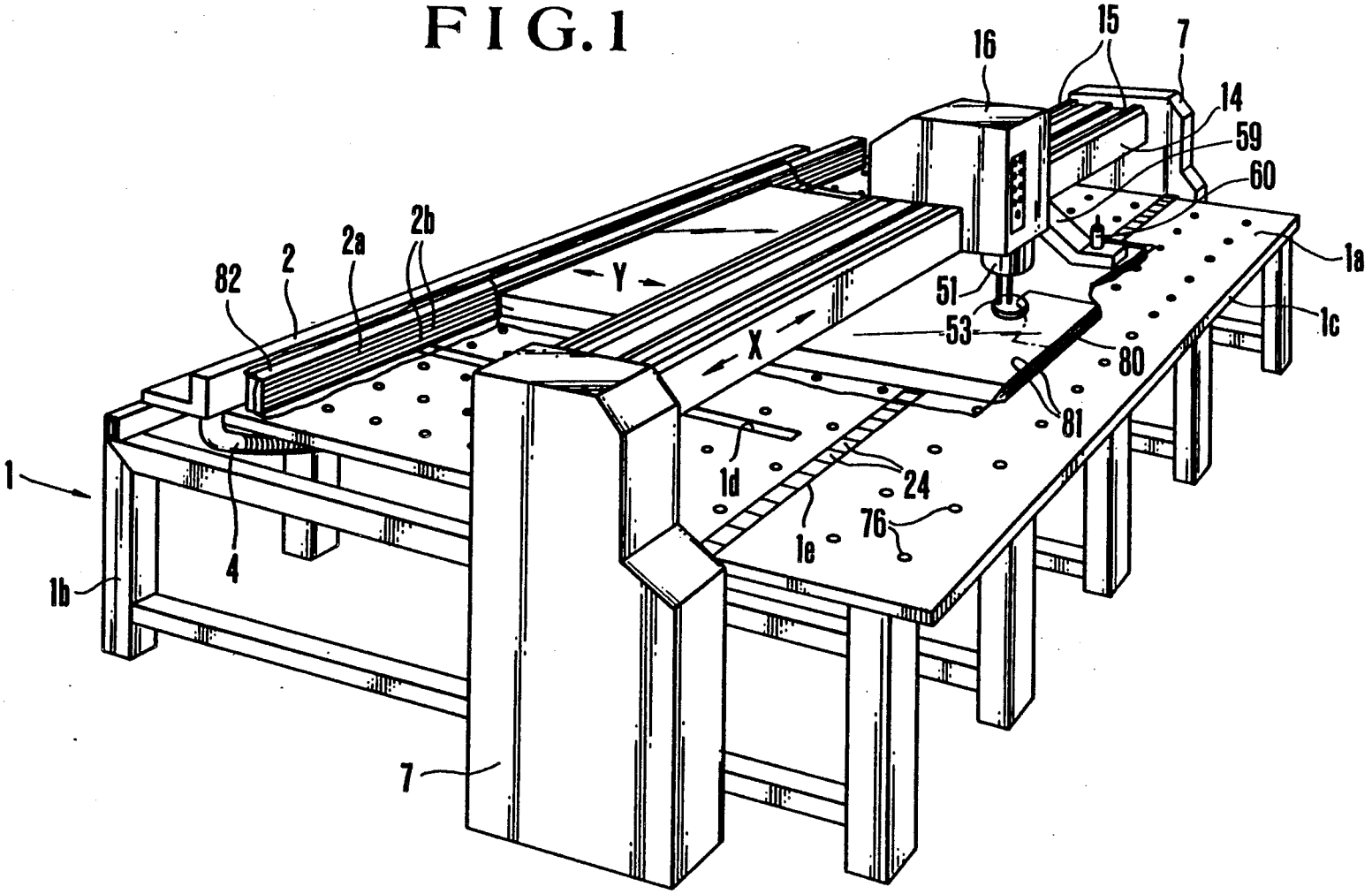
FIG. 1 is perspective view illustrating an embodiment of a laminated sheet material cutting apparatus according to the present invention.
Figure 2:
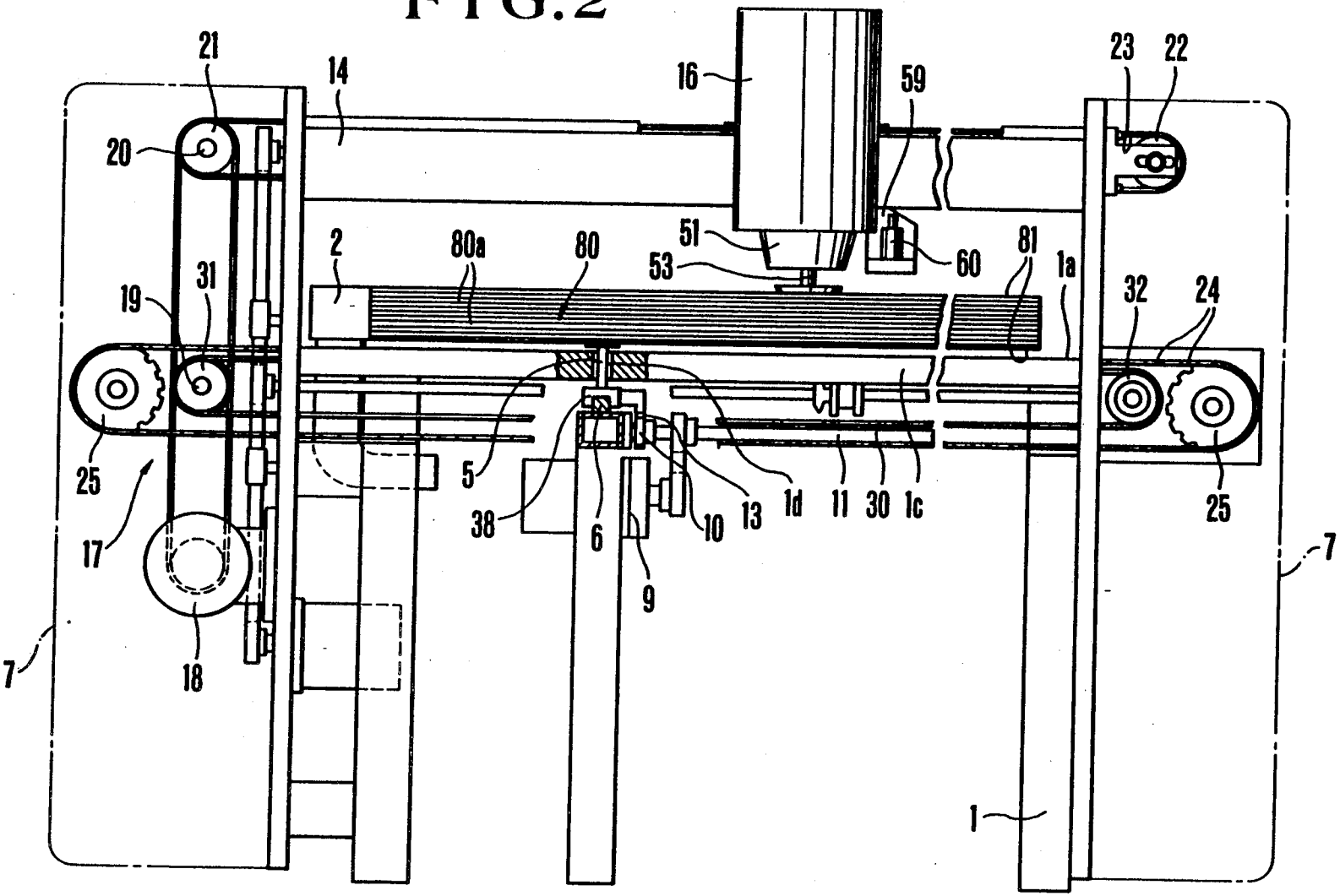
FIG. 2 is a front view with identical portions cut away.
Figure 3:
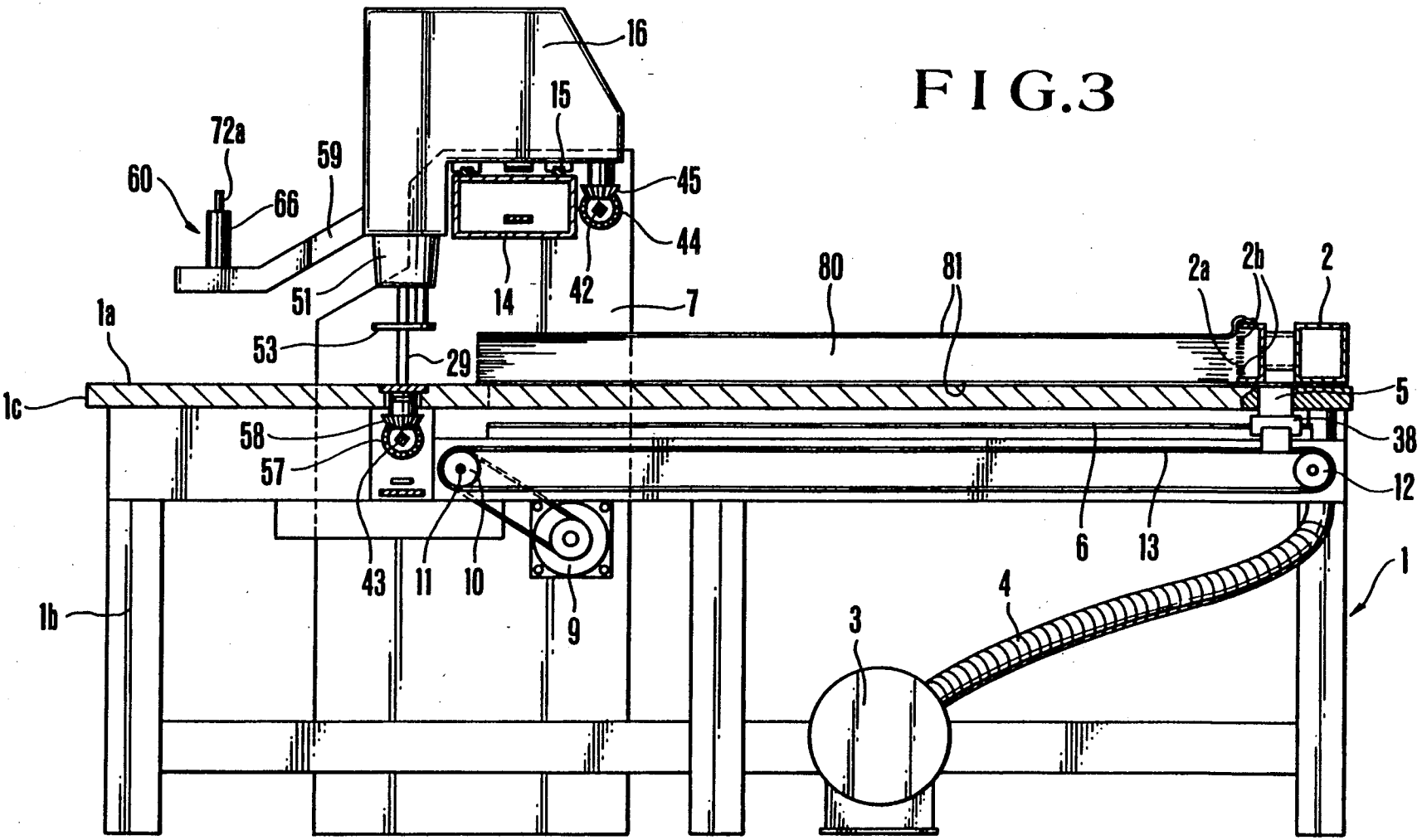
FIG. 3 is a transverse sectional view of the apparatus.

With reference to FIGS. 1 through 3, a cutting apparatus in accordance with the invention includes a pedestal 1 fixed to a floor by legs 1*b* to which a plate 1*c* having a rectangular supporting surface 1*a* is secured. A suction pipe 2 is provided on the supporting surface 1*a* and extends longitudinally of the supporting surface 1*a* over substantially the entire length of the long side thereof, which is the X direction. Provided in one side face of the suction pipe 2 is a suction port 2*a* having a number of crosspieces 2*b* extending in the X direction. The interior of the suction pipe 2 is connected via a flexible hose 4 with a suction source 3, such as an air pump, installed on the floor. A plurality of guide holes 1*d* extending in a direction (Y direction) parallel to the short side of the supporting surface 1*a* are formed in the plate 1*c* in the X direction from the left side to the right side of the plate in FIG. 1. A retaining member 5 provided on the lower surface of the suction pipe 2 is fitted into the guide hole 1*d* and is capable of being reciprocated therealong. The retaining member 5 is supported on a rail 6 via a rail seat 38, and the rail 6 is supported below the plate 1*c* of the pedestal 1. A pair of frames 7 are erected outwardly of the short sides of the pedestal 1 in contact therewith. Secured to one of these frames is a motor 9 for reversibly rotating a suction pipe drive unit 8. The latter includes a pair of drive gears 10 driven by the motor 9 and coupled to each other by a connecting shaft 11. The rail seat 38 is coupled to a endless belt 13 comprising a chain or timing belt stretched between the drive gear 10 and a driven gear 12.

A beam member 14 extends between the upper ends of the frames 7 and has an upper surface to which a pair of guide rails 15 extending longitudinally of the beam are secured. As also shown in FIG. 3, a cutter head 16 is engaged with and supported by the guide rails 15 so as to be capable of being reciprocated in the X direction. The beam 14 is situated to lie above the distal end of the guide hole 1*d* near the right side of the pedestal 1 as shown in FIG. 1.

Figure 6:
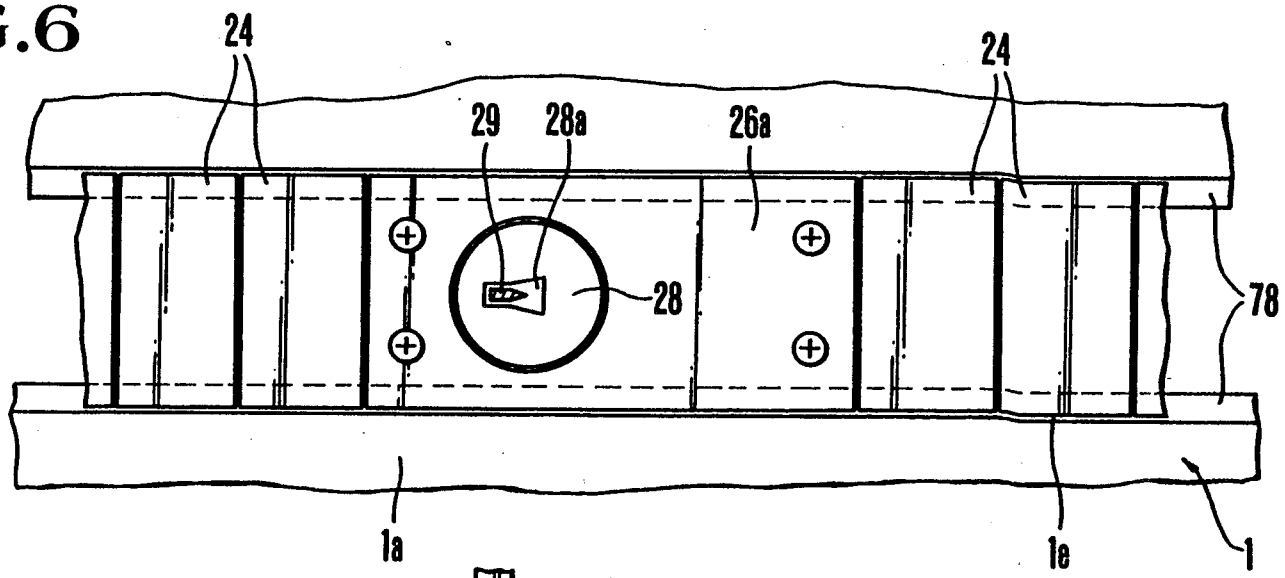
FIGS. 6 and 7 are a plan view and vertical sectional view showing a portion of the apparatus including a mounting member.
Figure 7:
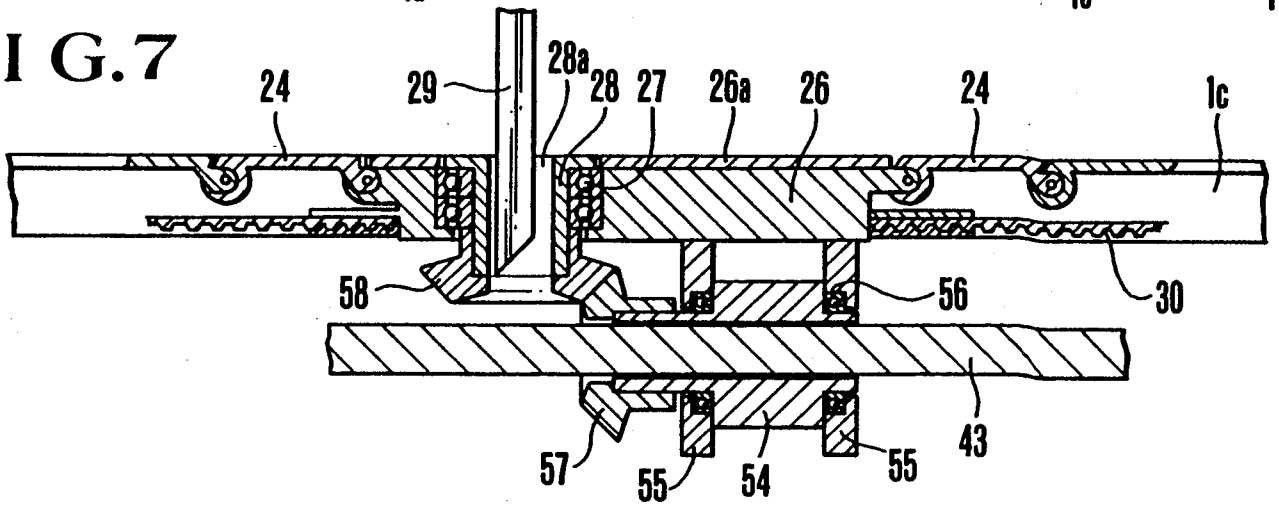

A cutter head drive unit 17 includes a reversible drive motor 18 secured to one of the frames 7, a first drive shaft 19 supported on this frame and driven by the motor 18 via an endless belt or the like, and a second drive shaft 20 supported on this frame and driven in synchronization with the first drive shaft 19 via an endless belt or the like. A drive gear 21 is secured to the second drive shaft 20, a tension gear 22 is secured to the other frame 7, and an endless belt 23 comprising a chain or a timing belt provided within the beam 14 is stretched between the gears 21, 22. The lower surface of the cutter head 16 is coupled to the endless belt 23. A guide groove 1*e* extending longitudinally of the beam 14 is formed in the support surface 1*a* of the pedestal 1 immediately below cutter head 16. As shown in FIGS. 6 and 7, a number of closure plates 24 are supported in the guide groove 1*e* so as to be capable of reciprocating in the X direction. The closure plates 24 are pivotally interconnected and provide an endless belt together with a mounting member 26 connecting the closure plates 24 and engaged with and supported by gears 25 supported on respective ones of the frames 7. A cutter receiving sleeve 28 is held by the mounting member 26 and is capable of turning about its axis in a bearing 27. The receiving sleeve 28 has a bore 28*a* into which the tip of a cutter 29 attached to the cutter head 16 in a manner described below is fitted so as to be capable of moving up and down. The bore 28*a* is slidingly contacted at both side faces and the back face of the cutter 29 and is provided with a clearance with respect to the blade end of the cutter. The upper surfaces of the closure plates 24, the upper surface of the cutter receiving sleeve 28, and the upper surface of a slide plate 26*a*, which is fixed to the mounting member 26 and forms a portion thereof, are arranged to be flush with the supporting surface 1*a* of pedestal 1, as best shown in FIG. 7.

A timing belt 30 is coupled to the mounting member 26 and is stretched between a drive gear 31 provided on the first drive shaft 19 and a driven gear 32 supported on the other frame 7. The timing belt 30 is disposed on the inner peripheral side of the endless belt constructed by the closure plates 24 and mounting member 26.

Figure 5:
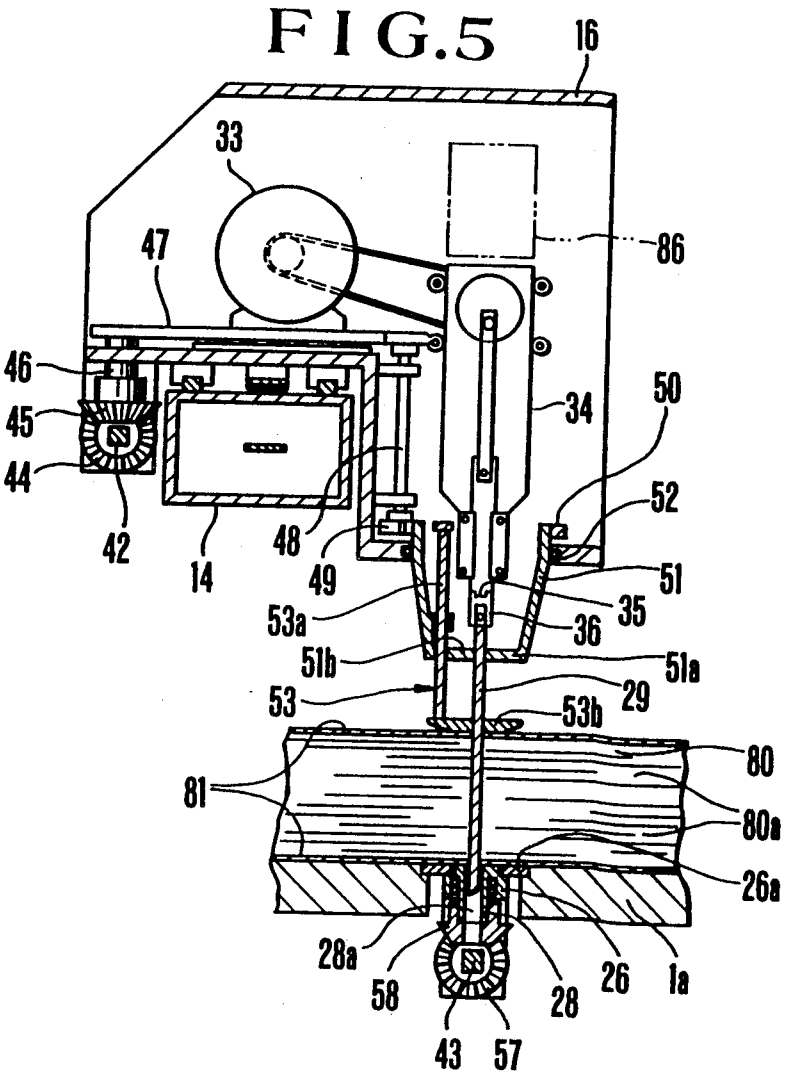
FIG. 5 is a vertical sectional view showing a portion of the apparatus including the cutter head.

As shown in FIG. 5, a motor 33 for raising and lowering the cutter 29 is secured within the cutter head 16. A crank mechanism 34 which converts the rotation of the motor 33 into an up-and-down linear reciprocating motion is supported on the cutter head 16. A retaining member 36 is coupled via a bearing 35 to the lower or output end of the crank mechanism 34, and the base end of the cutter 29 is detachably retained by the retaining member 36 so as to be capable of turning about the axis thereof.

Figure 4:
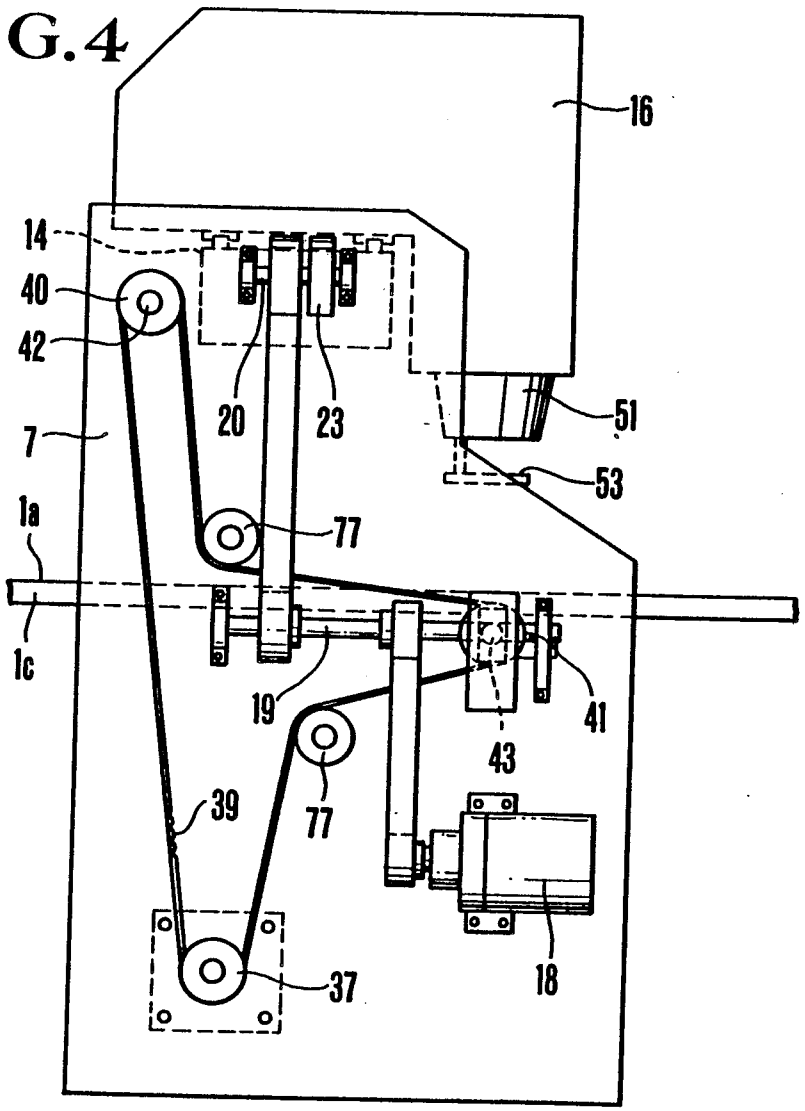
FIG. 4 is an explanatory side view of a cutter head and frame portion of the apparatus.

As shown in FIG. 4, a reversible motor 37 for directing the cutter is secured inside one of the frames 7. The driving force from the motor 37 is transmitted via a timing belt 39 to upper and lower gears 40, 41. Securely fitted into the upper and lower gears 40, 41 are upper and lower engaging shafts 42, 43 each comprising a spline shaft or square shaft. As illustrated in FIG. 5, the upper engaging shaft 42 extends longitudinally of the beam 14 and is rotatably supported by the frames 7. The lower engaging shaft 43 extends longitudinally of the closure plates 24 and mounting member 26 and is rotatably supported therebelow by the frames 7. A driving bevel gear 44, to which the driving force is transmitted by the upper engaging shaft 42, is engaged therewith so as to be slidable on shaft 42 in its axial direction. A driven bevel gear 45 meshes with the driving bevel gear 44 and is secured to a vertical shaft 46 supported on the cutter head 16. A pinion shaft 48 to which the driving force from the vertical shaft 46 is transmitted by a timing belt 47 is supported on the cutter head 16 so as to lie parallel to the cutter 29. A pinion 49 secured to the lower end portion of the pinion shaft 48 meshes with a ring gear 50. The ring gear 50 is secured to the upper end portion of an upper cutter guide 51. The latter has a cylindrical upper portion supported via a bearing 52 so as to be capable of turning about its axis but incapable of moving vertically. The upper cutter guide 51 has a bottom 51*a* the central portion of which is formed to include a directing hole 51*b* through which the cutter 29 passes so as to be capable of being moved up and down. The hole 51*b* is slidingly contacted by both side faces and the back face of the cutter 29 and is provided with a clearance with respect to the blade end of the cutter.

Figure 9:
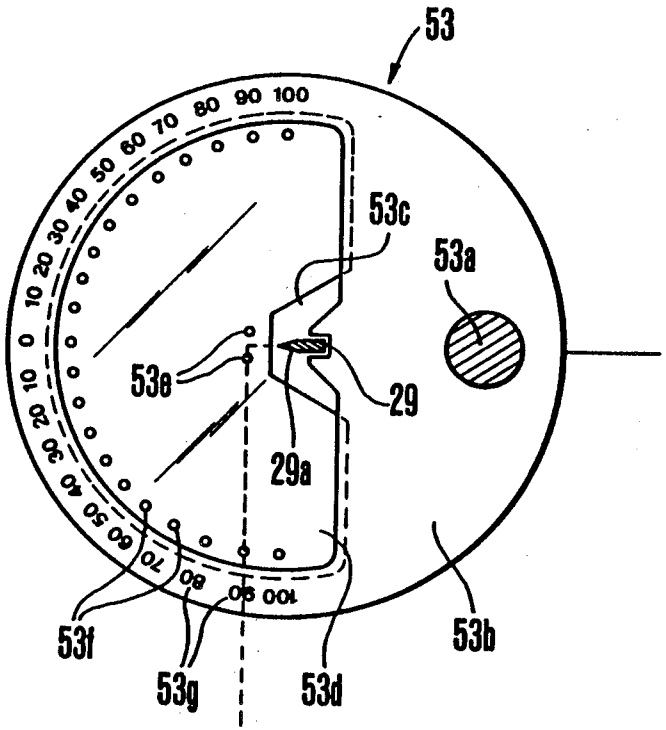
FIG. 9 is a horizontal sectional view showing an intermediate cutter guide portion of the apparatus.
Figure 8:
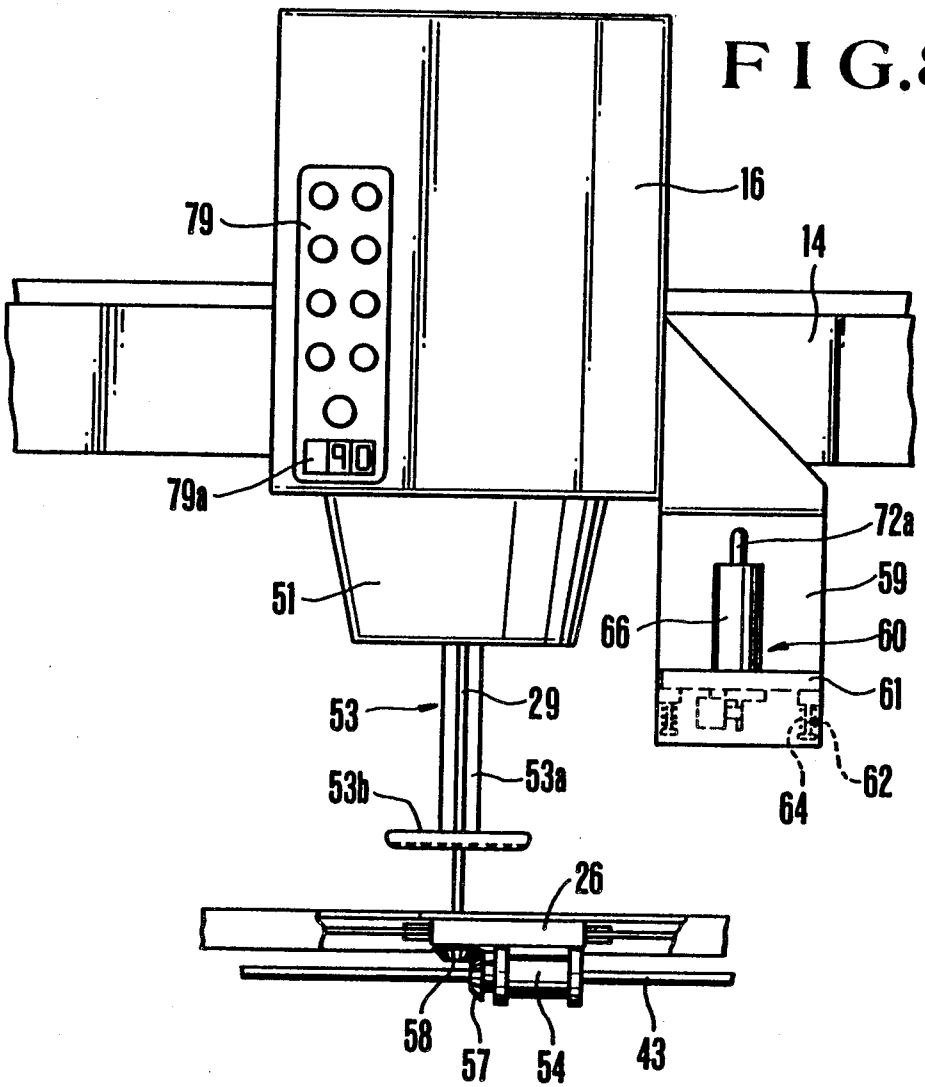
FIG. 8 is a front view of the cutter head portion.

An intermediate cutter guide 53 has an eccentric shaft 53*a* which is inserted into and supported by the bottom 51*a* of the upper cutter guide 51 so as to be movable up and down. The bottom 51*a* is adapted so that the intermediate cutter guide 53 is stopped at any desired vertical position by suitable means. As shown in FIGS. 8 and 9, the intermediate cutter guide 53 includes a disk 53*b* formed integral with its lower end. The central portion of the disk 53*b* is formed to include a directing hole 53*c* through which the cutter 29 passes so as to be capable of being moved up and down. A portion of the disk 53b is provided with a transparent section 53d. The hole 53c is slidingly contacted by both side faces and the back face of the cutter 29 and is provided with a clearance with respect to the blade end of the cutter. The transparent section 53d is provided with a pair of guide marks 53e and 10° graduations 53f extending from 0° to 100° on either side of the blade end 29a of cutter 29. An direction angle indication 53g is provided along the perimeter of the graduations 53f.

As shown in FIGS. 5 through 7, a drive sleeve 54 to which the driving force of motor 18 is transmitted by the lower engaging shaft 43 is slidably disposed on and engages shaft 43 so as to be capable of sliding axially thereof, but rotating therewith. The drive sleeve 54 is rotatably retained via bearings 56 in a pair of holding plates 55 secured to the lower surface of the mounting member 26. A driving bevel gear 57 fixedly fitted onto the drive sleeve 54 meshes with a driven bevel gear 58. The latter is fixedly fitted onto the cutter receiving sleeve 28.

Figure 10:
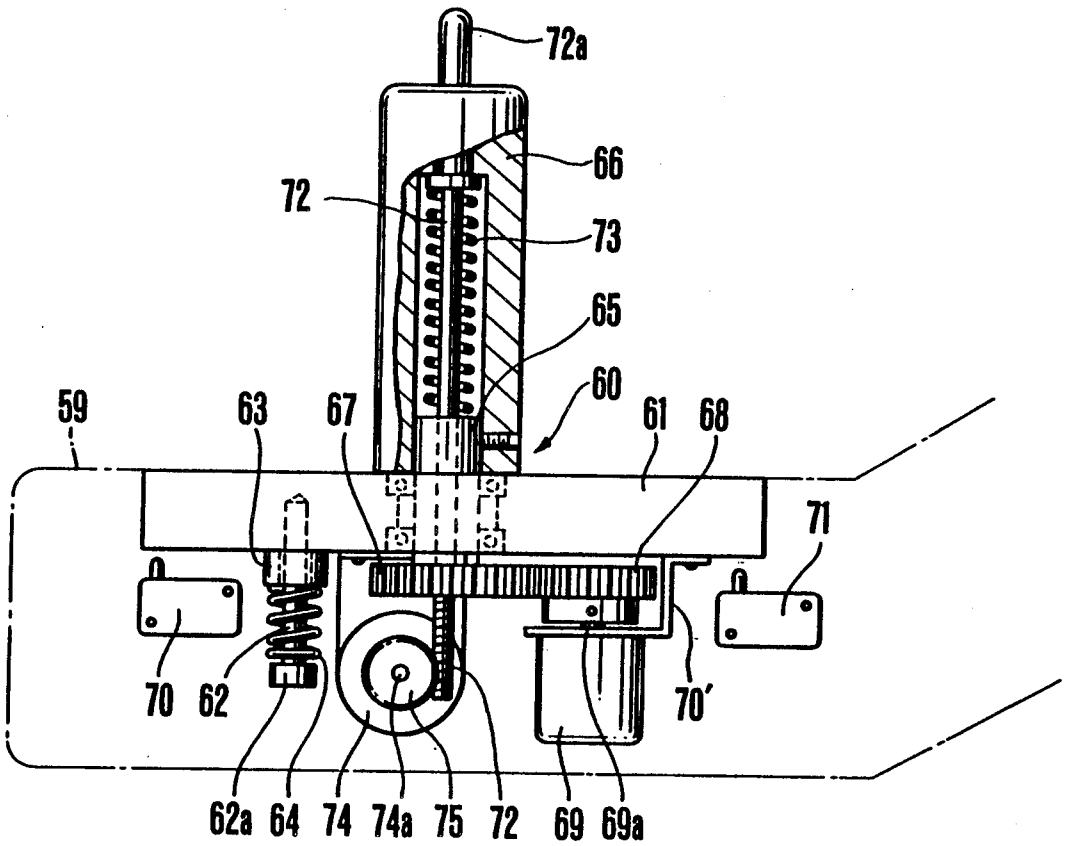
FIG. 10 is a side view with a portion of an operating unit cut away.

As shown in FIGS. 8 and 10, an arm 59 projects from the lower portion of the cutter head 16, and an operating unit 60 is mounted on the distal end of the arm 59. The operating unit 60 includes a handle disk 61 accommodated within the arm 59, a plurality of mounting screws 62 screwed into the lower surface of the handle disk 61 and loosely inserted into fixtures 63 secured to the arm 59, and a spring 64 interposed between each fixture 63 and a head portion 62a of each corresponding mounting screw 62. One side portion of the handle disk 61 is urged downwardly by the spring 64. The handle disk 61 supports an operating column 65 capable of turning about a vertical axis but incapable of moving up and down. A cylindrical operating handle 66 is securely fitted onto the upper end portion of the operating column 65. Provided on the lower end portion of the operating column 65 in coaxial relation therewith is an operating gear 67. Rotating force from the operating gear 67 is transmitted to a gear 68 fitted securely on a rotary shaft 69a of a rotary encoder 69. The latter is secured to the lower surface of the handle disk 61 by a bracket 70'. Though the operating gear 67 and the gear 68 provided on the rotary shaft 69a of the encoder 69 are meshing directly in FIG. 10, it is also possible to adopt an arrangement in which an endless belt such as a timing belt or chain is stretched between the operating gear 67 and the gear 68 to transmit the rotating force. Limit switches 70, 71 actuated by tilting motion of the handle disk 61 are arranged below the disk on both sides thereof. These switches 70, 71 are secured within the arm 59. A knob 72 is inserted in the operating handle 66 in concentric relation therewith. The knob 72, which has an upper end portion 72a projecting from above the operating handle 66, is urged upwardly by a spring 73 provided inside the handle 66. The knob 72 is passed slidably through the operating column 65 so that the lower end portion thereof projects below the column 65. This projecting end of the knob 72 is includes annular ribs 72b having a rack gear configuration. The protuberances 72b on knob 72 mesh with a gear 75 fitted securely on a shaft 74a of volume means 74. In response to rotation of its rotary shaft 69a, the rotary encoder 69 sends a signal to a control unit (not shown) having a numerical control function and is for the purpose of deciding the rotational ratio of the motor 9 of suction pipe drive unit 8 to the motor 18 of cutter head drive unit 17. In response to rotation of its shaft 74a, the volume dial 74 provides the control unit with a signal indicative of a change in voltage and is for the purpose of controlling the rotating speeds of the motors 9, 18. The limit switch 70 on the left side in FIG. 10 is for switching over the motors 9, 18 to rotation in a retracting direction only while it is closed. The limit switch 71 on the right side in FIG. 10 is for automatic cutting at portions where the cutting line is curved.

In FIG. 1, numeral 76 denotes a number of blow holes provided in the plate 1c of the pedestal 1 and connected to a blower or a source of pressurized air. In FIG. 4, numeral 77 denotes tension pulleys associated with the timing belt 39. These pulleys 77 are pivotally supported on the frame 7. In FIG. 6, numeral 78 denotes support members provided on both sides of the guide groove 1e on the lower side thereof. Both ends of the closure plates 24 and and mounting member 26 are supported on the support members 78. In FIG. 8, numeral 79 denotes a switch panel secured to the front side of the cutter head 17 at the lower end thereof, and numeral 79a denotes a digital display section provided on the switch panel 79.

The operation of the embodiment of the cutting apparatus constructed as set forth above will now be described.

First, as shown in FIGS. 1 through 3, a laminate 80 of a number of sheets 80a comprising fabrics or the like has its upper and lower surfaces covered by a flexible, air-impermeable sheet 81 consisting of vinyl chloride or the like. The laminate 80 covered by the the air-impermeable sheet 81 is placed upon the support surface 1a of the pedestal 1 after raising the intermediate cutter guide 53. The upper and lower surfaces of the laminate 80 and the periphery thereof, with the exception of the side face opposing the suction pipe 2, are covered by the air-impermeable sheet 81, the outer sides of the upper and lower surfaces of the suction port 2a are covered by the edge portions of the air-impermeable sheet 81 on the side thereof facing the suction pipe 2, the portion of the suction port 2a projecting from the laminate 80 and air-impermeable sheet 81 is covered by an air-impermeable tape 82, and the aforementioned exposed side face of the laminate 80 is butted against the suction port 2a. Under these conditions, the suction source 3 is operated to draw in air from the suction port 2a via the flexible hose 4, thereby compressing the laminate 80 of sheets 80a in the thickness direction thereof and attracting the aforementioned side face of the laminate to the suction port 2a. The intermediate cutter guide 53 is then lowered to abut the disk 53b against the upper surface of the laminate 80 via the air-impermeable sheet 81.

Next, the motor 9 of the suction pipe drive unit 8 and the motor 18 of the cutter head drive unit 17 are driven into operation by manipulating the operating unit 60 in a manner described later. The drive gear 10 is rotated by operation of the motor 9, thereby moving the retaining member 5 along the guide hole 1d via the endless belt 13. Thus, the suction pipe 2 and the laminate 80, along with the air-impermeable sheet 81, are moved in the Y direction on the support surface 1a of the pedestal 1. When this is done, the laminate 80 and air-impermeable sheet 81 are free to move on the support surface 1a and the support surface is free of any projections that would impede movement. As a result, the the laminate and air-impermeable sheet are capable of being moved freely on the support surface 1 by a comparatively small driving force. Furthermore, when air is blown on the support surface 1a from the blow holes 7b, 76 provided in the plate 1c, the frictional resistance between the support surface 1a and the air-impermeable sheet 81 on the lower surface of the laminate 80 is reduced, thereby facilitating further the movement of the laminate 80 along with the air-impermeable sheet 81.

The first and second drive shafts 19, 20 are rotated synchronously by operation of the motor 18. The drive gear 21 is rotated by rotation of the second drive shaft 20, whereby the cutter head 16, together with the cutter 29 attached thereto, is moved longitudinally of the beam 14, namely in the X direction, along the guide rail 15 via the endless belt 23. At the same time, the drive gear 31 is rotated by rotation of the first drive shaft 19, whereby the mounting member 26 is moved, via the timing belt 30, in the X direction along the guide groove 1e provided in supporting surface 1a. The cutter receiving sleeve 28 held by the mounting member 26 and the closure plates 24 coupled to the mounting member 26 also move together in the X direction. In other words, the cutter 29 and the cutter receiving sleeve 28 into which the tip of the cutter is inserted are moved together in the X direction at identical speeds.

When the motor 33 for raising and lowering the cutter is operated, rotation of the motor is converted into vertical, linear reciprocating motion by the crank mechanism 34, so that the cutter 29 is reciprocated vertically via the bearing 35 and retaining member 36. When this done, both side faces and the back face of the cutter 29 come into sliding contact with, and are guided by, the wall of the directing hole 51a in upper cutter guide 51, the wall of the directing hole 53c provided in the disk 53b of intermediate cutter guide 53, and the wall of the bore 28a of the cutter receiving sleeve 28. Thus, the cutter 29 is moved up and down over a predetermined stroke while being supported at three points along its length at all times.

Thus, the laminate 80 and air-impermeable sheet 81, along with the suction pipe 2, move in unison in the Y direction, and the cutter 29, along with the cutter head 16, moves in the X direction. As a result of these combined movements, the laminate 80, along with the air-impermeable sheet 81, is capable of being cut over its entire thickness in any direction from the periphery thereof with the exception of the side face opposing the suction pipe 2. Since there are no obstructions on the supporting surface 1a, the laminate 80 can be kept flat, without bends, curves or wrinkles, and may be accurately cut even down to its lowermost layer without any of the sheets 80a shifting position. Furthermore, since the cutter 29 is supported at three points along its length by the walls of the directing holes 51a, 53c and bore 28a, flexing of the cutter due to elastic deformation or the like does not readily occur. This feature also contributes to accurate cutting of the laminate 80.

In order to perform the foregoing operations, an operator turns the operating handle 66 of the operating unit 60, thereby turning the rotary shaft 69a of the rotary encoder 69 via the operating column 65, operating gear 67 and gear 68. The rotary encoder 69 responds by generating a signal delivered to the control unit 83 shown in FIG. 11. The latter sends numerical control signals to the motor 9 of the suction pipe drive unit 8 and the motor 18 of the cutter head drive unit 17, whereby the laminate 80 is moved in the Y direction and the cutter head 16 is moved in the X direction, with the ratio of rotation of motor 9 to motor 18 being decided by the numerical control signals. At the same time, the control unit 83 sends a numerical control signal to the cutter directing motor 37 to drive the same, as a result of which the upper and lower engaging shafts 42, 43 are driven synchronously. The upper engaging shaft 42 causes the upper cutter guide 51 to turn, together with the intermediate cutter guide 53, via the driving bevel gear 44, driven bevel gear 45, vertical shaft 46, timing belt 47, pinion shaft 48, pinion 49 and ring gear 50. The lower engaging shaft 43 causes the cutter receiving sleeve 28 to turn via the drive sleeve 54, driving bevel gear 57 and driven bevel gear 58. The upper cutter guide 51, intermediate cutter guide 53 and cutter receiving sleeve 28 turn in the same direction and through the same angle simultaneously. Thus, the cutter 29 is directed by the directing holes 51b, 53c and bore 28a to decide the direction in which the laminate 80 is cut by the cutter 29. Accordingly, the ratio of movement of the laminate 80 in the Y direction to the ratio of movement of the cutter 29 in the X direction owing to movement of the cutter head 16 is decided by turning the operating handle 66, and the orientation of the cutter 29 is decided at the same time. This makes it possible to cut the laminate 80 in the desired direction.

When the knob 72 of the operating unit 60 is depressed against the force of the spring 73, the shaft 74a of the volume means 74 is turned via the rack gear-shaped annular projections 72b and the gear 75. The volume means 74 converts this rotation into a voltage signal delivered to the control unit 83. If the motors 9, 18 are rotated at a higher speed in response to this signal, the speed at which the laminate 80 will be cut by the cutter 29 will also increase. When the downward pressure on the knob 72 is released, the knob 72 is restored to its raised position by the spring 73, thereby stopping the motors 9, 18. Accordingly, the speed at which the laminate 80 is cut by the cutter 29 can be set to a suitable value depending upon the amount by which the knob 72 is depressed.

Figure 11:
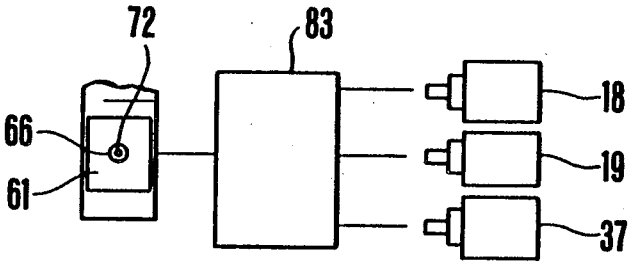
FIG. 11 is a view useful in describing a control unit.

In response to turning of the operating handle 66, the control unit 83 shown in FIG. 11 reads, as angle data, the angle through which the encoder 69 is rotated by turning the operating handle 66, computes a rotational angle on the basis of the angle data, and sends a command indicative of the computed rotational angle to the cutter directing motor 37. The control unit 83 also reads the voltage of the volume means 74 as speed data, computes the rotational speeds of the motors 9, 18 on the basis of the speed data and angle data, and sends commands indicative of these computed rotational speeds to the motors 9, 18. The foregoing manipulations are performed by writing a cutting guide line 84 (see FIGS. 14, 15) on a paper pattern affixed to the air impermeable sheet 81 covering the upper surface of the laminate, or by writing the cutting guide line 84 on the sheet 81, and viewing the guide line 84 through the transparent section 53d of the intermediate cutter guide 53.

Figure 12:
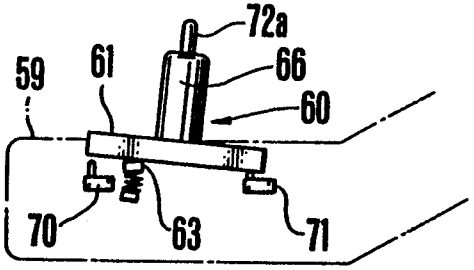
FIGS. 12 and 13 are views for describing the operation of the operating unit and showing two different operating states.
Figure 13:
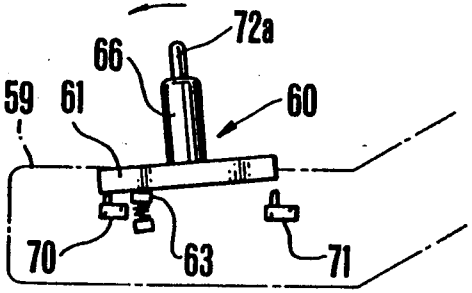
Figure 15:
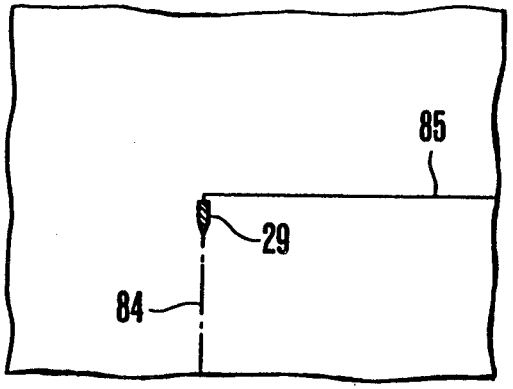
FIG. 15 is a view for describing the cutting operation after a cutter is swiveled.
Figure 14:
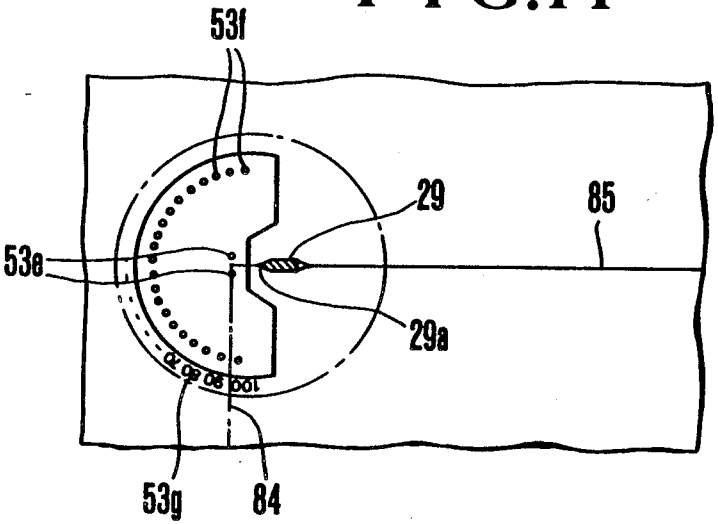
FIG. 14 is a view for describing a cutting operation at a corner portion.
Figure 16:
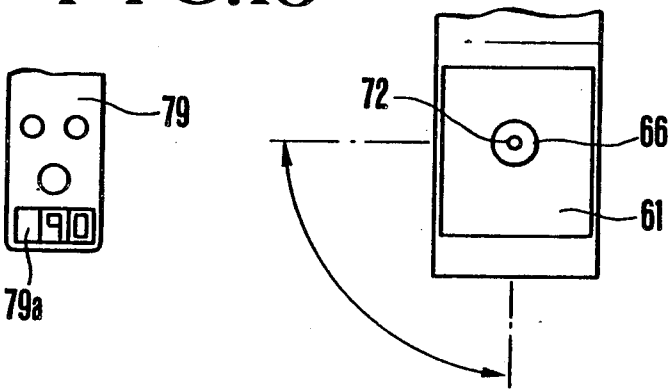
FIG. 16 is a view for describing operation and shows the relationship between an operating handle and a switch panel.

When the operating handle 66 at a neutral position shown in FIG. 10 is tilted to the left side together with the handle disk 61, thereby closing the limit switch 70 on the left side, as shown in FIG. 12, the control unit 83 causes the motors 9, 18 to be rotated reversely, i.e. in a retracting direction, while the switch 70 is closed. When the operating handle 66 is tilted to the right side together with the handle disk 61, thereby closing the limit switch 70 on the right side, as shown in FIG. 13, a starting position signal which prevails when cutting the corner portion of the cutting line is sent to the control unit 83. When the operating handle 66 is temporarily returned to the neutral position and rotated, after which the operating handle 66 is tilted to close the limit switch 71 on the right side, automatic cutting conforming to the angle of rotation of the operating handle 66 can be carried out. More specifically, as shown in FIG. 14, by moving the cutter 29 along the cutting guide line 84 through manual manipulation of the operating handle 66, the laminate is cut up to a position near the guide marks 53*e* while the operator looks through the transparent section 53*d* of the intermediate cutter guide 53, the limit switch 71 on the right side is closed, and the angle of the direction in which the cutter 29 is advancing is verified by the graduations 53*f* and indications 53*g* on the outercircumferential side of the transparent section 53*d*. While the operating handle 66 is being rotated in a direction identical with the direction of cutter advance, it is set to the numerical value, e.g. 90°, which is displayed on the digital display 79*a* provided on the switch panel 79 shown in FIG. 16, so that the angle verified by the graduations 53*f* will be obtained. Then, by reclosing the limit switch 71, the cutter 29 will be swiveled through 90°, as shown in FIG. 15, so that the cutting of the corner portion along the guide line 84 can be performed automatically. Numeral 85 in FIGS. 14 and 15 denotes the cut line.

When the above-described automatic cutting operation is performed at the corner portion, the laminate can be cut at the correct angle, without producing rounding at the corner portion, even if cutting is performed along a line which bends at a large angle of, for example, 90°. In such case, the control unit 83 reads, as data, the magnitude of the angle through which the encoder is rotated from the output of the signal produced by closure of the limit switch 71 to the output of this signal produced by reclosure of the same switch. The control unit 83 then computes the amounts of rotation and the rotational speeds of the motors 9, 18, 37 based on preprogrammed data and the data from the encoder, and issues commands for controlling the motors 9, 18, 37 to the prescribed amounts of rotation and rotational speeds.

In the foregoing embodiment, an elevating unit having a motor for raising and lowering the crank mechanism 34 and the cutter 29 connected to the crank mechanism 34 is provided inside the cutter head 16, as indicated by the phantom line 86 in FIG. 5. It is preferred that the cutter 29 be raised by the elevating unit 86 via the crank mechanism 34 to withdraw the cutter 29 from the cutter receiving sleeve 28 and lift it above the laminate 80 and air-impermeable sheet 81, after which the cutter is lowered to restore it to the state that prevailed before withdrawal.

Figure 17:
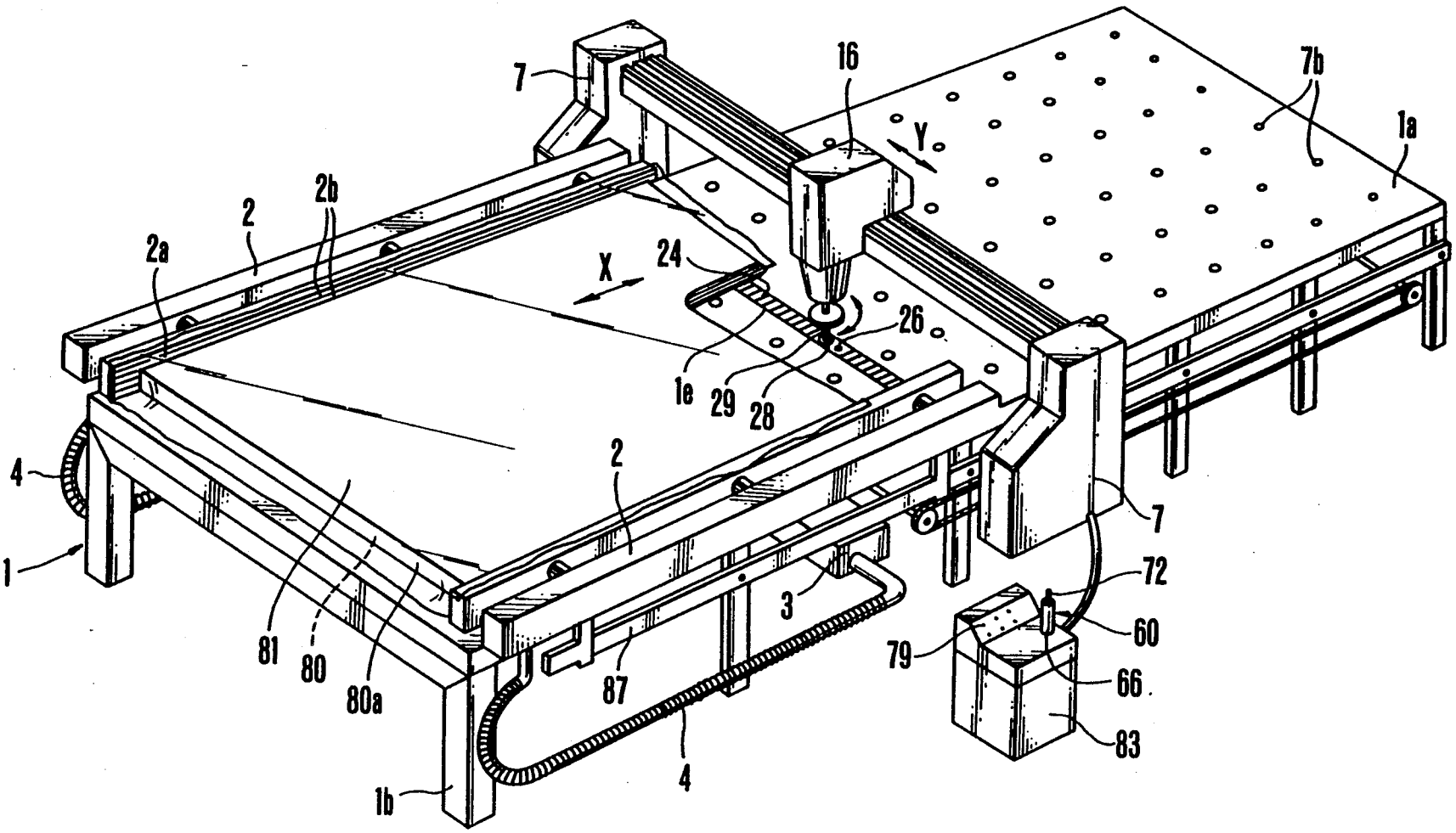
FIG. 17 is a perspective view illustrating another embodiment of a laminated sheet material cutting apparatus according to the present invention.

FIG. 17 illustrates another embodiment of the present invention. Here left and right suction pipes 2 which move together in the X direction are provided to flank the long sides of the supporting surface 1*a* of pedestal 1, and it is arranged so that the suction pipes 2 travel on rails 87 secured to the pedestal 1. The frames 7 and beam 14 are provided centrally of the pedestal 1 in terms of the X direction, and a cutter head 16 which moves in the Y direction is mounted on the beam 14. The mounting member 26 having the closure plates 24 and the cutter receiving sleeve 28 and moved in the guide groove 1*e* in the Y direction is provided below the cutter head 16. The cutter head 16 is not provided with an arm or operating unit. The operating unit 60 and the switch panel 79 are installed in the control unit 83, which is disposed exteriorly of the pedestal 1. In all other aspects, the arrangement is substantially similar to that shown in FIGS. 1 through 16, and the basic operation also is approximately the same. The cutting apparatus shown in FIG. 17 is well suited for fully automated cutting by means of numerical control. Portions in FIG. 17 corresponding to those in FIGS. 1 through 16 are designated by like reference characters.

In accordance with the present invention as described hereinabove, the guide groove is provided in the supporting surface of the pedestal, the multiplicity of closure plates driven in synchronization with the cutter head and the mounting member having the cutter receiving sleeve mounted thereon are provided, in interconnected fashion, within the guide groove, and the upper surfaces of the closure plates, cutter receiving sleeve and mounting member are arranged flush with the supporting surface. Accordingly, the laminate of sheet material, at least the upper and lower surfaces of which are covered by the air-impermeable sheet, is reciprocated on the supporting surface together with the suction pipe sucking the laminate from one side face thereof, and the cutter is reciprocated together with the cutter head in a direction orthogonal to the laminate on the supporting surface. As a result of these motions, the sheets of the laminate are cut accurately down to the lowermost layer by the cutter mounted on the cutter head, thereby making it possible to cut each sheet into the same prescribed shape. In addition, the cutter head and the laminate can be moved smoothly by a comparatively small driving force.

As many apparently widely different embodiments of the present invention can be made without departing from the spirit and scope thereof, it is to be understood that the invention is not limited to the specific embodiments thereof except as defined in the appended claims.

What is claimed is:

1. An apparatus for cutting sheet material, comprising:

(a) means defining a support surface for supporting the sheet material to be cut, said support surface having an elongated guide groove recessed therein, said groove having parallel sidewalls;

(b) means for reciprocally supporting a cutting element disposed in the sheet material;

(c) means for moving said reciprocating cutting element supporting means in a direction normal to the direction of reciprocation of said cutting element and axially of said elongated guide groove;

(d) a movable support strip supported in said guide groove and disposed relative to said cutting element supporting means to receive the end of the cutting element after passing through the sheet material, said movable support strip including means for receiving the end of said cutting element;

(e) means for moving said strip along said guide groove in the direction of movement of said cutting element support and in synchronism with such movement, said strip having parallel sidewalls disposed adjacent mating sidewalls of said guide groove, thereby providing an uninterrupted coplanar support surface at the location of said movable strip on said support surface; and wherein said guide groove has a recessed shoulder associated with each sidewall thereof, and said support strip has a thickness at its lateral edges equal to the depth of said shoulders from said support surface, whereby the bottoms of the lateral edges of said support strip slidably engage said shoulders, and the top surface of said support strip is flush with said support surface.

* * * * *